US011505342B2

(12) United States Patent
Hölle et al.

(10) Patent No.: US 11,505,342 B2
(45) Date of Patent: Nov. 22, 2022

(54) THERMOFORM PACKAGING MACHINE WITH FLEXIBLE PACKAGE SUPPORT

(71) Applicant: MULTIVAC Sepp Haggenmüller SE & Co. KG, Wolfertschwenden (DE)

(72) Inventors: Markus Hölle, Lautrach (DE); Klaus Weiß, Bad Grönenbach (DE); Florian Lutz, Ottobeuren (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 250 days.

(21) Appl. No.: 16/034,314

(22) Filed: Jul. 12, 2018

(65) Prior Publication Data

US 2019/0016494 A1 Jan. 17, 2019

(30) Foreign Application Priority Data

Jul. 14, 2017 (EP) ..... 17181383

(51) Int. Cl.
*B65B 61/06* (2006.01)
*B65B 41/16* (2006.01)
(Continued)

(52) U.S. Cl.
CPC ..... *B65B 7/164* (2013.01); *B26D 1/09* (2013.01); *B65B 9/04* (2013.01); *B65B 41/16* (2013.01);
(Continued)

(58) Field of Classification Search
CPC ..... B65B 59/02; B65B 59/04; B65B 59/00; B65B 59/003; B65B 7/164; B65B 61/065;
(Continued)

(56) References Cited

U.S. PATENT DOCUMENTS 2,358,292 A * 9/1944 Malhiot ..... B65G 17/26 198/803.11
2,639,025 A * 5/1953 Schmitt ..... B65G 15/48 198/803.5
2,827,153 A * 3/1958 Olk ..... B65G 13/12 198/790
3,001,348 A * 9/1961 Pickering ..... B29C 65/18 53/550
(Continued)

FOREIGN PATENT DOCUMENTS

CN 201686049 U 12/2010
CN 201686050 U 12/2010
(Continued)

*Primary Examiner* — Robert F Long
*Assistant Examiner* — Eduardo R Ferrero
(74) *Attorney, Agent, or Firm* — Brooks Kushman P.C.

(57) ABSTRACT

A thermoform packaging machine comprising a forming station, a sealing station, and a cutting station for separating sealed packaging troughs from one another. The cutting station may comprise at least one cutting unit which is adapted to be positioned within the cutting station at different positions in the production direction. The cutting station may comprise a support that supports bottoms of the sealed packaging troughs conveyed into the cutting station for the purpose of separation from below. The support may comprise a plurality of support elements arranged in a horizontal bearing plane and which form a gap at a position in the support at which a cutting operation takes place according to the position of the cutting unit. The gap may be repositioned by moving the support elements to different positions to position the gap to accommodate a different position of the cutting unit within the cutting station.

20 Claims, 5 Drawing Sheets

(51) Int. Cl.

| | |
|---|---|
| ***B65B 43/08*** | (2006.01) |
| ***B65B 51/10*** | (2006.01) |
| ***B65B 7/16*** | (2006.01) |
| ***B65B 61/10*** | (2006.01) |
| ***B65B 9/04*** | (2006.01) |
| ***B26D 1/09*** | (2006.01) |
| ***B65B 65/00*** | (2006.01) |
| ***B65B 59/00*** | (2006.01) |

(52) U.S. Cl.
CPC ..... *B65B 43/08* (2013.01); *B65B 51/10* (2013.01); *B65B 59/003* (2019.05); *B65B 61/06* (2013.01); *B65B 61/065* (2013.01); *B65B 61/10* (2013.01); *B65B 65/00* (2013.01)

(58) Field of Classification Search
CPC ..... B65B 61/04; B65B 61/06; B65B 61/10; B65B 61/28; B65B 9/04; B65B 65/00; B65B 41/16; B65B 43/08; B65B 51/10; B65B 59/005; B65B 59/001; B26D 1/09; B26D 7/06; B26D 5/007; B26D 7/2628; B65G 13/11; B65G 13/12; B65G 17/002; B65G 17/46; B65G 7/04; B65G 13/00; B65G 17/00; B65G 1/02; B65G 1/023; B29C 66/0326
USPC ..... 53/559, 453, 511, 433, 329.3–329.5; 198/867.1, 867.08
See application file for complete search history.

(56) References Cited

U.S. PATENT DOCUMENTS 3,276,558 A * 10/1966 Guske ..... B65G 13/12 193/35 TE
3,343,336 A * 9/1967 Bradford ..... B65B 61/06 53/329.4
3,344,903 A * 10/1967 Holm ..... B65G 13/071 198/790
3,436,894 A * 4/1969 Sorensen ..... B65B 43/52 53/478
3,530,755 A * 9/1970 Gugler ..... A21C 15/04 83/355
3,581,875 A * 6/1971 Guis ..... B65G 13/071 198/782
3,587,829 A * 6/1971 Sorensen ..... B65B 7/164 198/867.12
3,685,251 A * 8/1972 Mahaffy ..... B29C 51/445 53/559
3,706,175 A * 12/1972 Anderson ..... B26D 1/365 53/478
3,708,954 A * 1/1973 Wilke ..... B65B 7/2814 53/329.4
3,726,376 A * 4/1973 Gotham ..... B65G 1/023 193/35 R
3,792,567 A * 2/1974 Balcome ..... B65B 7/164 53/329
3,809,210 A * 5/1974 Anderson ..... B65B 7/165 198/803.1
3,843,298 A * 10/1974 Rossig ..... B28B 5/028 425/296
3,851,445 A * 12/1974 Schuh ..... B65B 7/164 53/329
3,857,474 A * 12/1974 Hutson ..... B65G 17/26 198/626.5
3,908,342 A * 9/1975 Raque ..... B29C 66/87443 53/329.4
4,012,888 A * 3/1977 Nichols ..... B29C 51/18 53/131.3
4,121,404 A * 10/1978 Davis ..... B65B 7/165 53/329
4,133,163 A * 1/1979 Wilson ..... B65B 9/02 53/141
4,196,561 A * 4/1980 Kruse ..... B26D 1/36 198/341.04
4,296,589 A * 10/1981 Kruse ..... B65B 59/005 53/300
4,366,894 A * 1/1983 Huelster ..... B65G 13/11 193/35 R
4,369,613 A * 1/1983 Gess ..... B65B 25/14 53/553
4,405,050 A * 9/1983 Fenton, Jr. ..... B07B 13/18 198/782
4,483,125 A * 11/1984 Suga ..... B65B 9/067 53/372.5
4,569,185 A * 2/1986 Feliks ..... B65B 11/48 53/580
4,601,159 A * 7/1986 Mugnai ..... B65B 31/021 53/511
4,641,742 A * 2/1987 Igarashi ..... B65G 15/105 198/626.5
4,662,149 A * 5/1987 Hamilton ..... B65B 9/045 53/453
4,681,203 A * 7/1987 Kornylak ..... B65G 13/11 193/35 R
4,693,356 A * 9/1987 Pi-May ..... B65G 13/12 193/35 F
4,999,979 A * 3/1991 Vicq ..... B65B 9/045 53/559
5,058,364 A * 10/1991 Seiden ..... B65B 43/123 53/455
5,238,101 A * 8/1993 Ota ..... B65G 17/26 198/626.5
5,248,155 A * 9/1993 Togashi ..... B65B 59/003 279/4.11
5,360,099 A * 11/1994 Culpepper ..... B65B 35/24 198/473.1
5,513,741 A * 5/1996 Ellis ..... B07B 1/14 193/35 TE
5,636,728 A * 6/1997 Best ..... B65G 13/12 193/35 TE
5,857,558 A * 1/1999 Irvine ..... B65G 17/44 198/803.2
6,024,207 A * 2/2000 Looser ..... B65G 17/26 198/473.1
6,182,819 B1 * 2/2001 Rehm ..... A47B 57/26 198/803.11
6,823,987 B2 * 11/2004 Sartore ..... B65G 17/26 198/803.11
7,340,871 B1 * 3/2008 Shackelford ..... B65B 47/00 53/453
7,506,491 B2 * 3/2009 Rimondi ..... B65B 31/043 53/389.2
7,752,828 B2 * 7/2010 Gudim ..... B65G 17/20 53/534
8,720,169 B2 * 5/2014 Ehrmann ..... B65B 9/04 100/207
8,752,357 B2 * 6/2014 Schiche ..... B65B 61/065 493/82
2003/0019714 A1 * 1/2003 Shaw ..... B65G 1/023 193/37
2005/0252351 A1 * 11/2005 Natterer ..... B65B 61/06 83/39
2005/0282692 A1 * 12/2005 Redden ..... B65G 39/06 492/40
2006/0113168 A1 * 6/2006 Bar ..... B65G 35/06 198/867.01
2006/0289275 A1 * 12/2006 Lemke ..... B65G 13/12 198/460.2
2008/0184676 A1 * 8/2008 Downhill ..... B65B 11/008 53/465
2011/0094195 A1 * 4/2011 Bartoli ..... B29C 66/849 53/558
2011/0271812 A1 * 11/2011 Maier ..... B26D 1/085 83/651
2012/0024673 A1 * 2/2012 Paskell ..... B65G 17/002 198/803.14

(56) References Cited

U.S. PATENT DOCUMENTS

2012/0108408 A1* 5/2012 Schiche ..... B65B 61/065 493/189
2012/0181141 A1* 7/2012 Sejourne ..... B65G 13/11 193/35 R
2012/0283083 A1* 11/2012 Ehrmann ..... B26F 1/40 493/199
2012/0289388 A1* 11/2012 Ehrmann ..... B29C 33/30 483/1
2013/0015155 A1* 1/2013 Brugmann ..... A47F 1/12 211/151
2013/0025243 A1* 1/2013 Spix ..... B65B 61/06 53/552
2014/0150377 A1* 6/2014 Ehrmann ..... B65B 47/02 53/453
2014/0250839 A1* 9/2014 Imhof ..... B65B 43/08 53/456
2014/0360845 A1* 12/2014 Bergler ..... B65G 47/88 198/817
2015/0107191 A1* 4/2015 Schiavina ..... B65B 31/028 53/291
2015/0203223 A1* 7/2015 Ehrmann ..... B65B 7/164 493/52
2016/0194101 A1* 7/2016 Palumbo ..... B65B 47/02 53/433
2017/0305585 A1* 10/2017 Rizzi ..... B29C 65/7451
2018/0334278 A1* 11/2018 Hu ..... B65B 59/04

FOREIGN PATENT DOCUMENTS

CN 103930349 A 7/2014
CN 205168973 U 4/2016
CN 206125561 U 4/2017
DE 202016000302 U1 2/2016
EP 249059 A1 12/1987
EP 2860119 A1 4/2015
EP 3088315 A1 11/2016

* cited by examiner

THERMOFORM PACKAGING MACHINE WITH FLEXIBLE PACKAGE SUPPORT

CROSS-REFERENCE TO RELATED APPLICATIONS

This Application claims priority to European Patent Application No. 17 181 383.5 filed on Jul. 14, 2017 to Markus Hölle, Klaus Weiß, and Florian Lutz, currently pending, the entire disclosure of which is incorporated herein by reference.

FIELD OF THE INVENTION

The present invention relates to a thermoform packaging machine having a more flexible cutting station to accommodate various package formats.

BACKGROUND OF THE INVENTION

In practice, thermoform packaging machines that are suitable for producing various package formats are in demand. In this respect, one of the challenges to be coped with by the manufacturer is to configure the cutting station used in the thermoform packaging machine after the sealing process such that it can be adjusted, without great effort, for separating different package formats from one another.

EP 0 249 059 A1 discloses a cutting unit for a packaging machine, in which the cutting unit is adapted to be adjusted, depending on respective container sizes, in the longitudinal direction of the machine frame by displacing it along guide profiles. In addition, the cutting unit is adapted to be adjusted, depending on the container depth, for differently sized opening gaps between the cutting tools provided thereon, so that differently sized types of containers can be produced using the cutting unit. For conveying the containers, clamping guides provided laterally on the machine frame of the cutting unit are used, using which the containers are cyclically conveyed through the cutting unit for separating them from one another.

Problems arise when large types of containers, especially when filled with heavy packaging contents, are to be optimally separated from one another by the cutting unit. In addition, it is difficult to accomplish using a thermoform packaging machine, in particular in the case of changing package formats, a consistently high quality of the products to be produced.

SUMMARY OF THE INVENTION

It is the object of the present invention, to improve a thermoform packaging machine with respect to known solutions, in particular against the practical background of format changes that are to be carried out frequently, by simple structural technical means in such a way that it will meet the highest hygienic standards, and will be adapted to be changed over quickly for a format change and to be used for reliably producing products of different formats having a consistently high quality.

The present invention relates to a thermoform packaging machine comprising a forming station for producing packaging troughs from a bottom film, a sealing station for closing the packaging troughs with a top film using a sealing process as well as a cutting station for separating sealed packaging troughs from one another. The cutting station comprises at least one cutting unit which may be adapted to be relocated within the cutting station between different positions in the production direction so as to be suitable for producing different package dimensions.

The cutting station further comprises a support using which bottoms of the respective sealed packaging troughs conveyed into the cutting station for the purpose of separation can, at least sectionwise, be supported from below. To this end, the support comprises a plurality of support elements, which are arranged in a horizontal bearing plane and which, according to a position of the cutting unit, form a predetermined gap at a position in the support at which a cutting operation takes place.

According to the present invention, said gap may also be formed by redistributing the support elements within the bearing plane, at a different position in the support for using the cutting unit at a different position within the cutting station. This means that an arrangement of the support elements may vary within the bearing plane so as to keep the gap open for operating the cutting unit at a desired position. In spite of a varying arrangement of the support elements for shifting the gap within the support, the entire support surface defined in the bearing plane will, however, substantially remain the same. Hence, the support produces for the package bottoms conveyed thereacross a flexible, equal-area supporting effect, which may be adaptable in an appropriate manner for separating different container formats from one another.

A gap within the meaning of the present invention may be an area in the bearing plane of the support where no support elements are positioned, said area being dimensioned such that a tool upper part of the cutting unit, for example a cutting blade, and/or a tool lower part of the cutting unit, for example, a die for the cutting blade, may, at least partially, pass therethrough, so that the tool upper part may be brought into contact with the tool lower part for thus creating a cutting operation, in particular a cut transversely to the production direction, for separating the sealed package products from one another.

Depending on the product to be produced, the support elements may be fixed within the bearing plane in different arrangements, so as to establish at a predetermined location along the production direction a gap for operating the cutting unit(s). The bottom support may be particularly advantageous for large packages with a heavy content. Due to the bottom support, the materials to be cut can be relieved from pulling forces, and this allows particularly precise and clean cuts to be made.

Preferably, the support comprises at least one carrier having releasably secured thereto a pre-determined number of support elements. It will be particularly advantageous when the support elements are releasably secured to the carrier without making use of a tool, so that they can quickly be removed from the carrier, without using any additional tools, and reinstalled at a different point of the carrier, in particular by clipping in.

According to an embodiment variant, the carrier comprises a first and a second rail, each provided with a plurality of reception units for fixing the respective support elements. The respective rails may be secured to a machine frame of the thermoform packaging machine in an advantageous manner. They define carrier components which are easy to produce, and they are in particular suitable for operation under the highest hygienic demands. A support in the case of which the respective reception units of the rails are spaced apart in an equidistant manner, in one embodiment at distances of approximately 3 to 8 cm, may be particularly suitable for being adapted to the operation site of the cutting unit.

It will be particularly expedient when the first and the second rail are, at least sectionwise, configured as angle brackets. This offers a particularly good possibility of fixing the rails to the machine frame of the thermoform packaging machine and/or to the frame of the cutting station.

The rails configured as angle brackets are additionally advantageous for fixing thereto the support elements in a stable and expedient manner. This can be accomplished especially by forming the respective reception units of the first and of the second rail, at least partially, in the two legs of the angle bracket.

According to the embodiment in question, the cutting unit may, for meeting optimal safety standards, comprise at least one blocking element configured to prevent fixing of at least one support element in the gap provided for the cutting unit. The blocking element, acting as a placeholder, can keep the gap open and prevent an operator from arranging, in the area of the gap, support elements, which might impede the cutting process. This may automatically assist an operator in arranging the respective support elements always at a correct location within the bearing plane of the support, so that an incorrect arrangement of the support elements can be avoided.

Preferably, the support elements are, at least partially, configured as shafts, in particular as cylindrical rods, which are arranged in parallel in the support, especially transversely to the production direction. Cylindrically configured support elements can be cleaned particularly thoroughly, cleaning agents will excellently run down on them, and, consequently, they offer little potential for an accumulation of contaminations. In addition, the intermediate spaces existing in the arrangement of shafts offer an excellent possibility of carrying out cleaning operations on other components of the thermoform packaging machine.

Furthermore, the operator will easily be able to manually relocate the shafts within the bearing plane of the support, when the thermoform packaging machine may be standing still and may be to be set for a format change.

When configured in the shape of cylindrical rods, the respective support elements exhibit a small friction surface, so that the packages conveyed through the cutting station for the purpose of separation can be conveyed with little resistance and so that in particular the bottoms pulled thereacross can be conveyed through the cutting station without getting damaged. According to a variant, the respective cylindrically configured support elements are arranged in an axially rotatable manner, so that they define a roller conveyor for the packages conveyed thereon.

According to an embodiment, the support may be arranged below a chain guide used for conveying the film. It would be imaginable to arrange the support in a height-adjustable manner. In order to be suitable for conveying packages having different depths, the support may especially be configured such that it may be continuously adjustable in height. In addition, it would also be imaginable to fix the support, preferably on different height levels, to a frame of the cutting unit and/or to the machine frame of the thermoform packaging machine.

Preferably, the cutting station comprises a further cutting unit for which a further gap in the sense of the present invention may be provided in the support. The two cutting units may be spaced apart in the production direction, substantially with respect to a length of the packages to be produced, so as to create cuts transversely to the production direction along opposed edge sections of the packages to be produced.

The packages to be produced can be conveyed into the cutting station in a particularly careful manner, when a guide for the sealed packaging troughs may be arranged at the inlet of the cutting station, when seen in the production direction. The guide may be preferably configured as a ramp so as to guide the packages onto a height level of the bearing plane of the support.

Other aspects and advantages of the present invention will be apparent from the following detailed description of the preferred embodiments and the accompanying drawing figures.

DESCRIPTION OF THE SEVERAL VIEWS OF THE DRAWING

In the following, an advantageous embodiment of the present invention will be explained in more detail making reference to a drawing, in which the individual figures show.

DETAILED DESCRIPTION OF THE INVENTION

Figure 1:
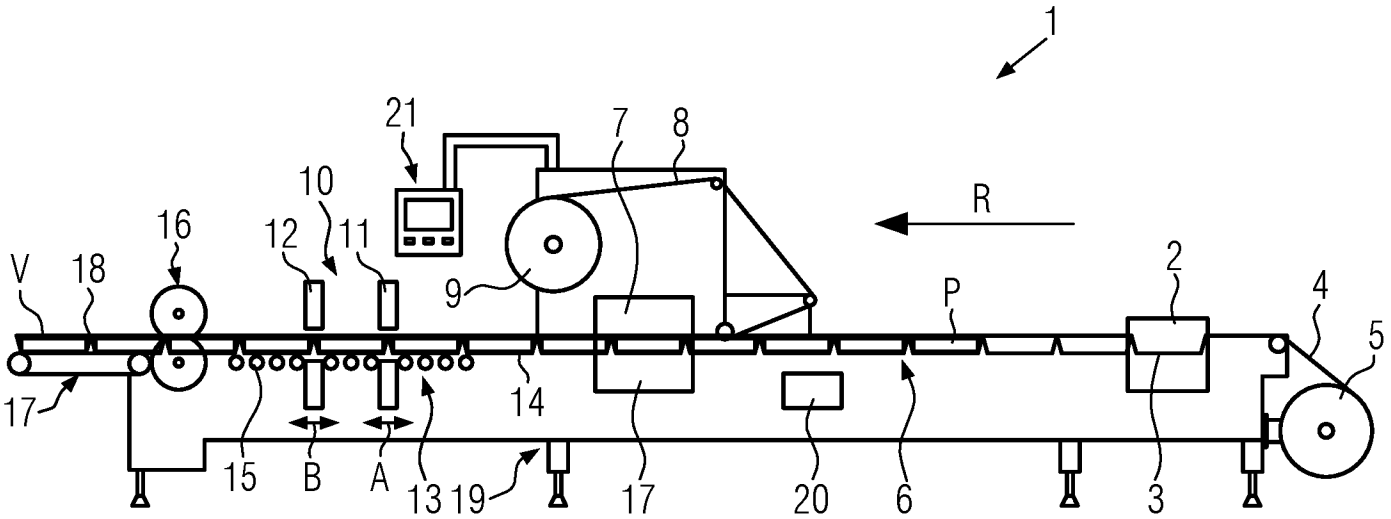
FIG. 1 is a side schematic view of one embodiment of a thermoform packaging machine in accordance with the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a thermoform packaging machine 1. The thermoform packaging machine 1 comprises a forming station 2 for producing packaging troughs 3 from a bottom film/foil 4, which is unwound from a bottom film roll 5 at the inlet of the thermoform packaging machine 1. When seen in the production direction R, the forming station 2 is followed by an infeed area 6. In the infeed area 6, products P can be fed into the packaging troughs 3 produced using the forming station 2.

Furthermore, the thermoform packaging machine 1 comprises a sealing station 7 for closing the packaging troughs 3 filled with the products P with a top film 8 using a sealing process. The top film 8 is unwound from a top film roll 9 and conveyed into the sealing station 7 for the sealing process.

For separating the packaging troughs 3, which leave the sealing station 7, from one another, the thermoform packaging machine 1 comprises a cutting station 10 located downstream of the sealing station 7 in the production direction R. According to FIG. 1, the cutting station 10 comprises a first cutting unit 11 as well as a second cutting unit 12 positioned further downstream in the production direction R. A double arrow A for the first cutting unit 11 as well as a double arrow B for the second cutting unit 12 indicate that, when seen in the production direction R, the respective cutting units 11, 12 are positionable at different positions within the cutting station 10, so that the cutting station 10 can be changed over for cutting differently sized packages V.

In addition, the cutting station 10 according to FIG. 1 has a support 13 arranged for supporting respective package bottoms 14. According to FIG. 1, the support 13 comprises a plurality of support elements 15 on the input side, between the two cutting units 11, 12, and on the output side of the cutting station 10.

A longitudinal cutting unit 16 is arranged further downstream in the production direction R as part of the cutting station 10 or independently thereof as a separate unit. This longitudinal cutting unit 16 is followed by a removal station 17 with a conveyor belt 18. There, the packages V produced can be removed from the thermoform packaging machine.

The respective functional units of the thermoform packaging machine 1, for example, the forming station 2, the sealing station 7 as well as the cutting station 10, are secured to a machine frame 19. And finally the thermoform packaging machine 1 also comprises a control unit 20 for the production process as well as a computer unit 21 for setting respective operating parameters.

Figure 2:
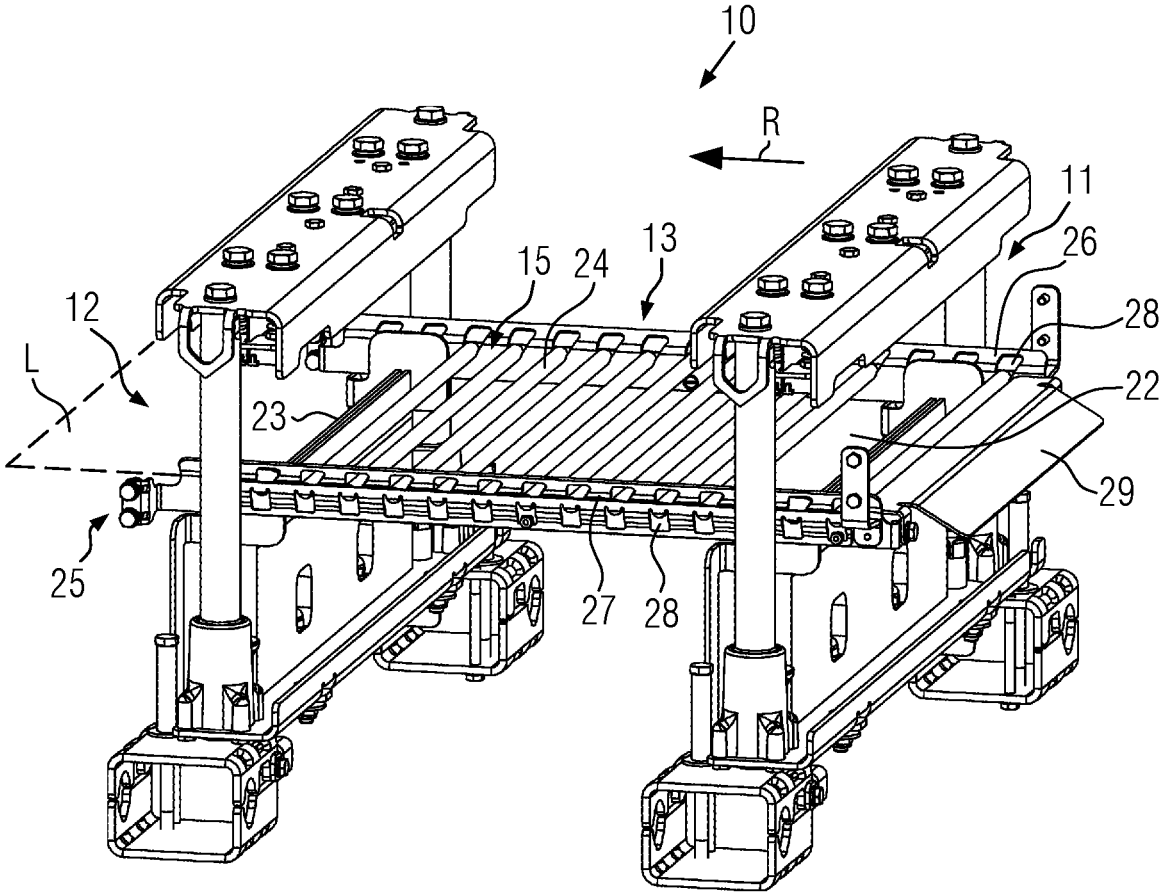
FIG. 2 is a front perspective view of one embodiment of a cutting station of a thermoform packaging machine in accordance with the present disclosure.

FIG. 2 shows, in a perspective view, a detail of the cutting station 10. The support 13 defines a predetermined gap 22 for the cutting process using the first cutting unit 11 and a further predetermined gap 23 for the cutting process using the second cutting unit 12.

The support elements 15 comprise, according to FIG. 2, a plurality of individual circular cylinders or shafts 24, which are arranged in the support 13. According to FIG. 2, the shafts 24 are secured in position in a horizontal bearing plane L. According to FIG. 2, the support 13 comprises one shaft 24 arranged on the input side and ten shafts 24 arranged between the two cutting units 11, 12. For cutting a smaller package format, the distance between two cutting units 11, 12 may be reduced, so that a shaft arrangement according to FIG. 1 may possibly be obtained.

The shafts 24 serve to support the bottoms of respective sealed packaging troughs 3 conveyed into the cutting station 10. According to FIG. 2, the support 13 comprises a carrier 25 for fixing the individual shafts 24, said carrier 25 having a first and a second rail 26, 27 for carrying the shafts 24. The first and second rails 26, 27 each comprise a plurality of reception units 28 in which the respective ends of the rodshaped support elements 15 can be secured in position, in particular clipped into position. According to FIG. 2, the respective reception units 28 are formed in the two rails 26, 27 in an equidistant manner along the production direction R.

Furthermore, FIG. 2 shows that a guide 29 is secured in position on the input side of the cutting station 10. The guide 29 has the shape of a ramp and is configured to guide packaging troughs 3 conveyed across said ramp onto the height level of the bearing plane L.

Figure 3:
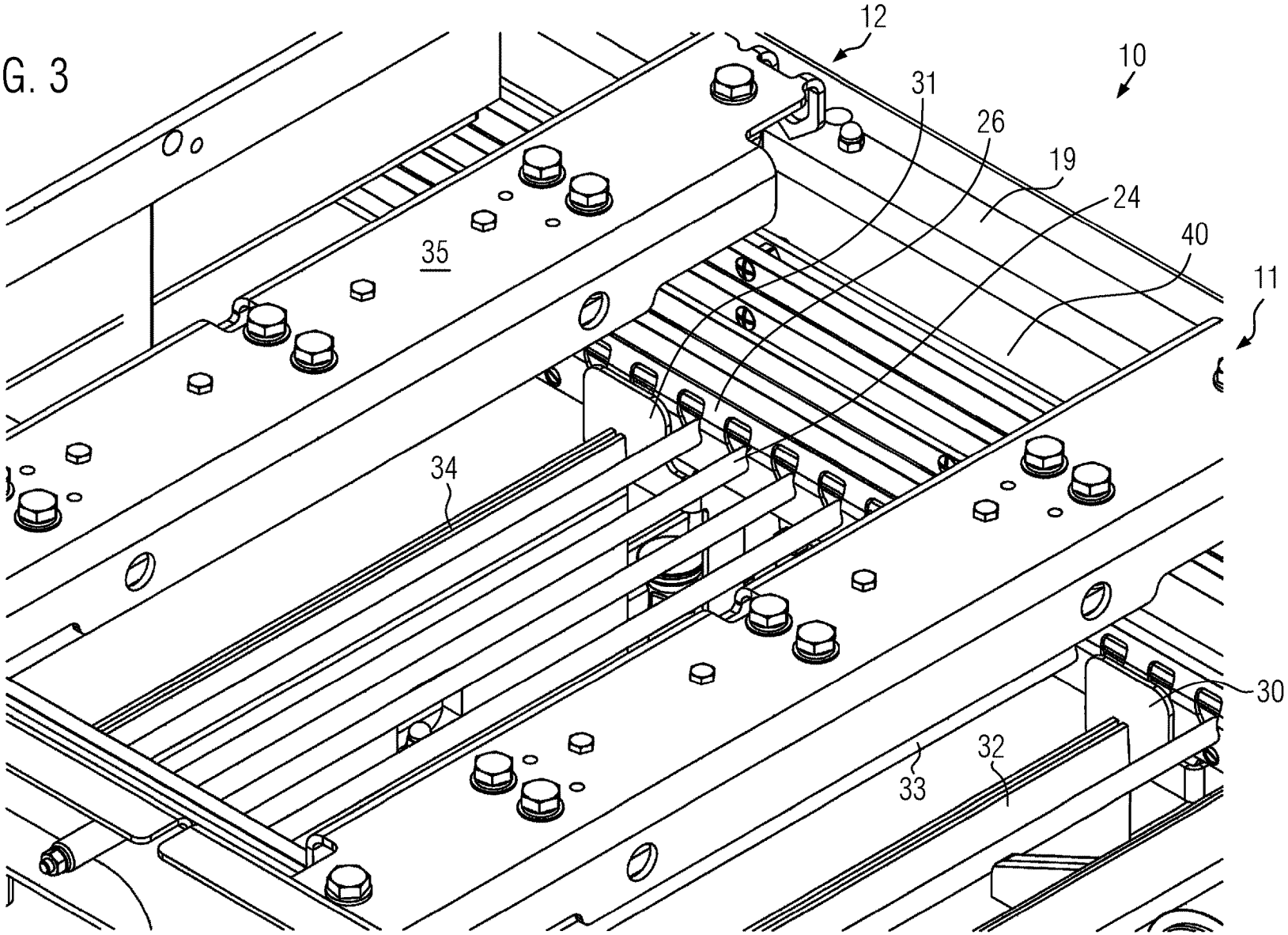
FIG. 3 is a top perspective view showing an enlarged representation of a detail of the cutting station of FIG. 2.

FIG. 3 shows, in a perspective and enlarged view, a detail of the cutting station 10. FIG. 3 shows that the first cutting unit 11 has a blocking element 30 and the second cutting unit 12 a blocking element 31. Complementary to the two blocking elements 30, 31, also additional blocking elements may be formed on the opposite sides of the respective cutting units 11, 12. The respective blocking elements 30, 31 are used as placeholders, so that it will be impossible to secure support elements 15 to the rails 26, 27 at the position of these blocking elements 30, 31 in the support 13. Hence, the blocking elements 30, 31 guarantee that collisions during the cutting process, which may be caused by an incorrect arrangement of one or of a plurality of shafts 24, will be prevented. In particular, the blocking elements 30, 31 guarantee that it is possible to bring a die 32 correctly into contact with a cutting blade 33 of the first cutting unit 11 and a die 34 correctly into contact with a cutting blade 35 of the second cutting unit 12 for carrying out a cutting operation. In addition, FIG. 3 shows a chain guide 40 provided for the purpose of film conveyance.

Figure 4:
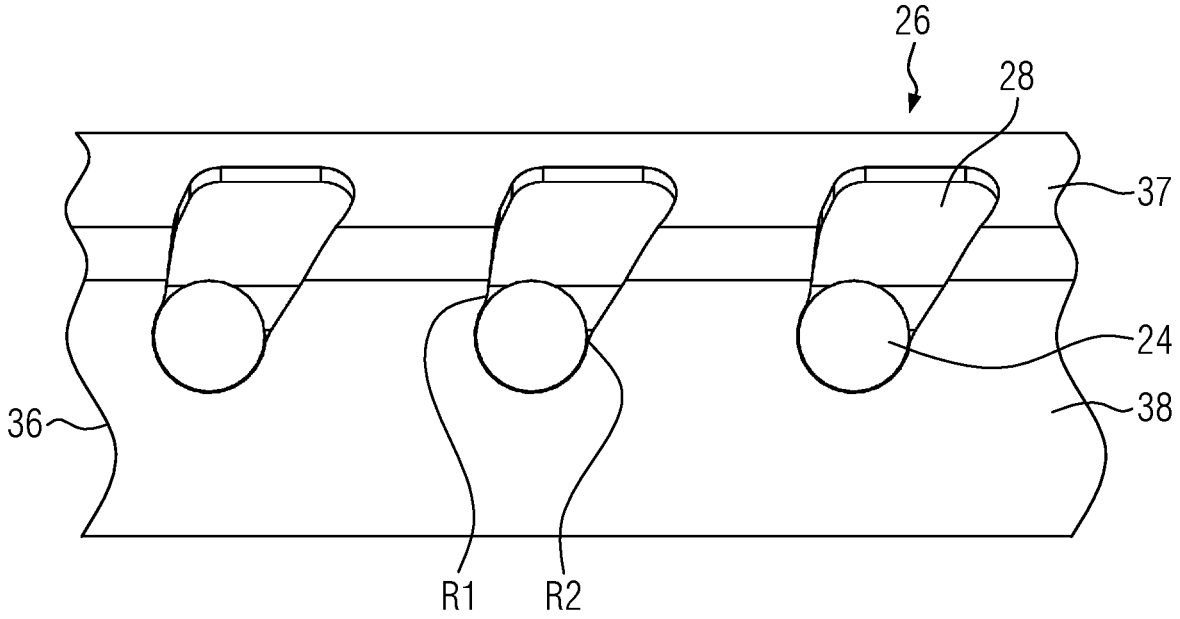
FIG. 4 is a side view of one embodiment of a rail of a cutting station of a thermoform packaging machine in accordance with the present disclosure, wherein the rail is an angle bracket having formed thereon reception units for insertion of the support elements.

FIG. 4 shows a detail of the first rail 26 including reception units 28 formed therein for fixing the shafts 24. According to FIG. 4, the first rail 26 has the shape of an angle bracket 36. The angle bracket 36 comprises a first leg 37 and a second leg 38. Preferably, the two legs 37, 38 extend at right angles to one another. In addition, FIG. 4 shows that the respective reception units 28 of the first rail 26 are formed, at least partially, in the two legs 37, 38 of the angle bracket 36. Respective ends of the shafts 24 are thus stably accommodated in the reception units 28 such that they project to a certain extent relative to the second leg 38.

FIG. 4 also shows that the reception units 28 have a first and a second radius R1, R2. These radii R1, R2 are configured such that they allow the shafts 24 to be pushed into the reception units 28 thereacross. The radii R1, R2 prevent the shafts 24 from leaving the reception units 28 on their own accord when the thermoform packaging machine 1 is in operation. Preferably, however, the radii R1, R2 may nevertheless allow the shafts 24 to be rotatably supported.

Figure 5A:
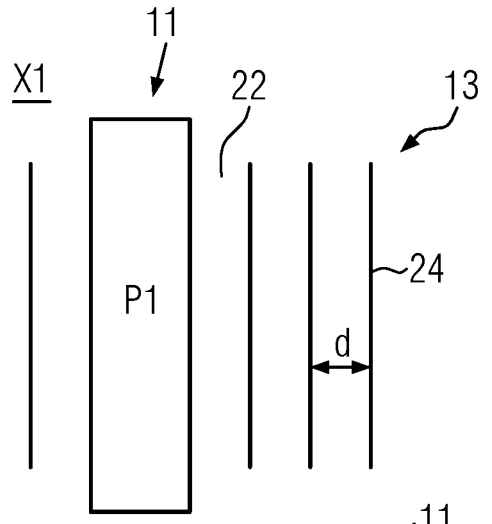
FIG. 5A is a schematic top view of one embodiment of a first arrangement of the support elements of a cutting station of a thermoform packaging machine in accordance with the present disclosure.
Figure 5B:
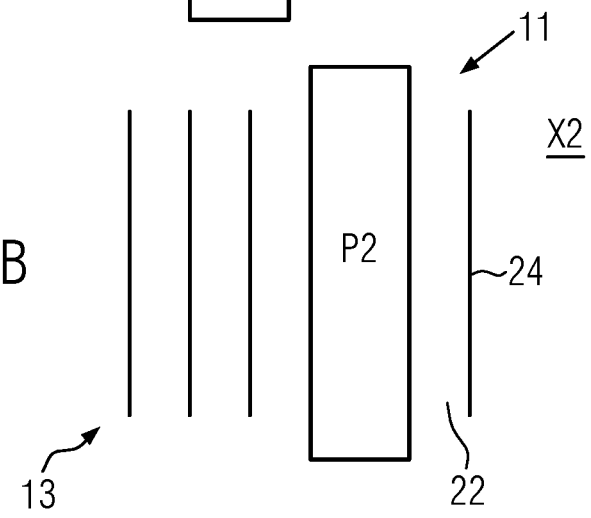
FIG. 5B is a schematic top view of one embodiment of a second arrangement of the support elements of a cutting station of a thermoform packaging machine in accordance with the present disclosure.

FIG. 5A shows, in a schematic representation, a first arrangement X1 of respective support elements 15 (here: shafts 24) for defining the gap 22 for the first cutting unit 11 in the cutting station 10. Alternatively, FIG. 5B shows a second arrangement X2 for defining the gap 22 for the cutting unit 11 further to the right in the support 13 when seen in the image plane.

This may be necessary for carrying out using the packaging machine 1 a format change with respect to packages V to be produced. On the basis of FIGS. 5A and 5B it can be seen that a displacement of the cutting unit 11 will entail a displacement of the respective shafts 24 within the support 13 so as to establish the gap 22 in the bearing plane L in an appropriate manner for operating the cutting unit 11. It follows that, according to FIGS. 5A and 5B, the cutting unit 11 can be displaced between a first position P1 and at least one second position P2, while maintaining an effective bottom support using the shafts 24.

FIG. 5A additionally shows a distance d between juxtaposed shafts 24. In one embodiment, the distance d lies within a range of approximately 3 to 15 cm, but it may also be much larger than that. By displacing one or a plurality of shafts 24, the gap 22 can be shifted precisely within small distances in the production direction, so that the cutting station 10 will be suitable for use for a large number of different package formats.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A thermoform packaging machine comprising:

a forming station for producing packaging troughs from a bottom film;

a sealing station for sealing the packaging troughs with a top film using a sealing process;

a cutting station for separating sealed packaging troughs from one another; and a machine frame, the forming station, the sealing station and the cutting stat ion are supported by the machine frame;

wherein the cutting station comprises at least one cutting unit which is adapted to be disposed within the cutting station at a plurality of different positions in a production direction;

wherein the cutting station comprises a support that supports the bottom of the sealed packaging troughs conveyed into the cutting station for the purpose of separation;

wherein the support comprises a first rail, a second rail and a plurality of support elements, the support elements arranged in a horizontal bearing plane, each of the first rail and the second rail including a plurality of reception units for releasably securing the plurality of support elements thereto, the support elements being receivable in the reception units, the reception units and the rails being static relative to the machine frame, the plurality of support elements being selectively positionable with the reception units and, according to the position of the cutting unit, to form a gap at a position in the support at which a cutting operation takes place according to a position of the cutting unit, wherein the gap provides an area in the bearing plane of the support where no support elements are positioned; and wherein the position of the gap is variable by selectively redistributing the arrangement of the support elements with the reception units within the bearing plane at a different position in the support to accommodate use of the cutting unit at the plurality of different positions within the cutting station.

2. The thermoform packaging machine according to claim 1, wherein the first rail and the second rail are angle brackets.

3. The thermoform packaging machine according to claim 2, wherein the respective reception units are at least partially formed in a first leg and a second leg of the angle bracket.

4. The thermoform packaging machine according to claim 1, wherein the cutting unit comprises at least one blocking element configured to prevent fixing of one of the plurality of support elements with certain of the reception units and to prevent fixing of one of the plurality of support elements in the gap provided for the cutting unit.

5. The thermoform packaging machine according to claim 1, wherein the support elements comprise shafts arranged in parallel.

6. The thermoform packaging machine according to claim 1, wherein the support is disposed below a chain guide that is used for conveying the top film through the packaging machine.

7. The thermoform packaging machine according to claim 1, wherein the cutting station comprises a second cutting unit and a second gap is provided in the support to accommodate the second cutting unit.

8. The thermoform packaging machine according to claim 1, further comprising a guide for the sealed packaging troughs arranged at the inlet of the cutting station when viewed in the production direction.

9. The thermoform packaging machine according to claim 1, wherein the first rail and the second rail are secured to the machine frame.

10. The thermoform packaging machine according to claim 1, wherein the support elements comprise cylindrical rods.

11. A thermoform packaging machine comprising:

a bottom film supply station for supplying a bottom film roll;

a forming station for producing packaging troughs from a bottom film;

a sealing station for sealing the packaging troughs with a top film;

a cutting station for separating sealed packaging troughs from one another; and a machine frame, the forming station, the sealing station and the cutting station are supported by the machine frame;

wherein the cutting station comprises at least one cutting unit adapted to be disposed within the cutting station at a plurality of different positions in a production direction;

wherein the cutting station comprises a support for supporting the bottom of the sealed packaging troughs conveyed into the cutting station;

wherein the support comprises a first rail, a second rail and a plurality of support elements, the support elements arranged in a horizontal bearing plane to form a gap at a position in the support at which a cutting operation takes place according to a position of the cutting unit, wherein the gap provides an area in the bearing plane of the support where no support elements are positioned, each of the first rail and the second rail including a plurality of reception units, the support elements being receivable in the reception units, the reception units and the rails being static relative to the machine frame, the plurality of support elements being releasably securable to the plurality of reception units to enable the plurality of support elements to be selectively positionable with the reception units to form the gap, the gap being formed according to the position of the cutting unit; and wherein the position of the gap being variable by selectively redistributing the arrangement of the support elements relative to the reception units within the bearing plane at a different position in the support to accommodate use of the cutting unit at the plurality of different positions within the cutting station.

12. The thermoform packaging machine according to claim 11, wherein the first rail and the second rail are angle brackets.

13. The thermoform packaging machine according to claim 12, wherein the respective reception units are at least partially formed in a first leg and a second leg of the angle bracket.

14. The thermoform packaging machine according to claim 11, wherein the cutting unit comprises at least one blocking element configured to prevent fixing of one of the plurality of support elements with certain of the reception units and to prevent fixing of one of the plurality of support elements in the gap provided for the cutting unit.

15. The thermoform packaging machine according to claim 11, wherein the support elements comprise shafts arranged in parallel.

16. The thermoform packaging machine according to claim 11, wherein the support is disposed below a chain guide that is used for conveying the top film through the packaging machine.

17. The thermoform packaging machine according to claim 11, wherein the cutting station comprises a second cutting unit and a second gap is provided in the support to accommodate the second cutting unit.

18. The thermoform packaging machine according to claim 11, further comprising a guide for the sealed packaging troughs arranged at the inlet of the cutting station when viewed in the production direction.

19. A thermoform packaging machine comprising:

a bottom film supply roll;

a forming station for producing packaging troughs from bottom film from the bottom film supply roll;

a sealing station for sealing the packaging troughs with a top film;

a cutting station for separating sealed packaging troughs from one another; and a machine frame, the forming station, the sealing station and the cutting station are supported by the machine frame;

wherein the cutting station comprises at least one cutter having a cutting tool upper part cooperable with a cutting tool lower part to perform a cutting operation, the cutter being disposable within the cutting station at a plurality of different positions in a production direction;

wherein the cutting station comprises a first rail, a second rail and a plurality of releasably secured supports for supporting the sealed packaging troughs conveyed into the cutting station;

wherein the plurality of releasably secured supports are arranged in a horizontal bearing plane to form a gap at a position in the support at which the cutting operation takes place according to a position of the cutter, wherein the gap provides an area in the bearing plane of the support where no support elements are positioned and where at least one of the cutting tool upper part and the cutting tool lower part passes during the cutting operation, wherein each of the first rail and the second rail includes a plurality of receptors, the plurality of supports being releasably securable to the plurality of receptors to enable the plurality of supports to be selectively positionable relative to the receptors to form the gap, the receptors and the rails being static relative to the machine frame, the gap being formed according to the position of the cutter; and wherein the position of the gap is selectively variable by repositioning the arrangement of the supports within the bearing plane at a different position to accommodate use of the cutter at the plurality of different positions within the cutting station.

20. The thermoform packaging machine according to claim 19, wherein the support is arranged in a height-adjustable manner.

* * * * *